US006405621B1

(12) United States Patent
Krivec et al.

(10) Patent No.: US 6,405,621 B1
(45) Date of Patent: Jun. 18, 2002

(54) RATCHET WRENCH WITH MULTI-POSITION RATCHET HEAD

(75) Inventors: Bert Krivec, Waukesha; Steven R. Wente; Jeffrey H. Hoff, both of Kenosha, all of WI (US)

(73) Assignee: Snap-on Tools Company, Kenosha, WI (US)

( * ) Notice: Subject to any disclaimer, the term of this patent is extended or adjusted under 35 U.S.C. 154(b) by 79 days.

(21) Appl. No.: 09/042,431

(22) Filed: Mar. 13, 1998

(51) Int. Cl.[7] ..... B25B 23/16
(52) U.S. Cl. ..... 81/177.9
(58) Field of Search ..... 81/177.8, 177.9, 81/177.7; 403/349

(56) References Cited

U.S. PATENT DOCUMENTS

| | | | | |
|---|---|---|---|---|
| 69,911 A | | 10/1867 | Harrigan | |
| 330,594 A | | 11/1885 | Lea | |
| 534,064 A | | 2/1895 | Hansen | |
| 943,757 A | * | 12/1909 | Stephens | 81/177.9 |
| 952,436 A | | 3/1910 | Miller | |
| 1,182,652 A | * | 5/1916 | Davis | 81/177.9 |
| 1,360,051 A | * | 1/1920 | Strang | 81/177.8 |
| 1,615,169 A | * | 1/1927 | Ellis | |
| 1,840,685 A | | 1/1932 | Witherup | |
| 2,060,523 A | * | 11/1936 | Packer | 403/349 |
| 2,608,894 A | | 9/1952 | Miller, Jr. et al. | |
| 2,705,897 A | * | 4/1955 | Kentish | 81/177.9 |
| 2,890,613 A | * | 6/1959 | Monckton | 81/58 X |
| 3,186,265 A | | 6/1965 | Wenturine et al. | |
| 3,383,962 A | | 5/1968 | Harris | |
| 3,423,781 A | * | 1/1969 | Henson | 403/349 |
| 3,779,107 A | | 12/1973 | Avery | |
| 4,463,632 A | | 8/1984 | Parke | |
| 4,541,310 A | | 9/1985 | Lindenberger | |
| 4,711,145 A | | 12/1987 | Inoue | |
| 4,747,328 A | | 5/1988 | Howard | |
| 4,794,829 A | | 1/1989 | Mesenhoeller | |
| 4,901,608 A | | 2/1990 | Shieh | |
| 5,199,335 A | | 4/1993 | Arnold et al. | |
| 5,280,738 A | | 1/1994 | Liou | |
| 5,522,287 A | | 6/1996 | Chiang | |

FOREIGN PATENT DOCUMENTS

| | | | | |
|---|---|---|---|---|
| EP | 0 027 238 | | 4/1981 | |
| EP | 0 070 725 | | 1/1983 | |
| EP | 0 309 880 | | 4/1989 | |
| EP | 0377777 | * | 7/1990 | 81/177.8 |
| GB | 273914 | * | 7/1927 | 81/177.8 |
| JP | 406179176 | * | 6/1994 | 81/177.8 |

OTHER PUBLICATIONS

Photos of Matco ratchet wrench, model No. BR12FTA (sold prior to Mar. 1997).
Photos of Matco ratchet wrench, model No. BR12LFT (sold prior to Mar. 1997).

* cited by examiner

*Primary Examiner*—D. S. Meislin
(74) *Attorney, Agent, or Firm*—Seyfarth Shaw

(57) ABSTRACT

A ratchet wrench is provided which includes a ratchet head having a part-cylindrical surface with head teeth thereon and an elongated handle hingedly coupled to the head. The handle has first and second handle ends, an axis extending between the ends and an axial first bore opening at the first handle end. The wrench also includes a rod disposed in and moveable within the first bore between an engaged condition engageable with the head teeth for locking the head in a selected position relative to the handle and a non-engaged condition disengaged from the head teeth and accommodating relative movement of the head and handle, and biasing structure for biasing the rod to the engaged condition. The wrench also includes retaining structure coupled to the rod for retaining the rod in its non-engaged condition. The retaining structure may be disposed at several locations relative to the ratchet head.

12 Claims, 3 Drawing Sheets

RATCHET WRENCH WITH MULTI-POSITION RATCHET HEAD

BACKGROUND OF THE INVENTION

1. Field of the Invention

This invention relates to rachet wrenches, and more particularly, to rachet wrenches with multi-position heads.

2. Description of the Prior Art

Ratchet wrenches with multi-position heads have previously been provided. These wrenches, however, had intricate and often awkward-to-use engaging mechanisms to maintain the head in a selected position relative to the wrench handle. Additionally, many of the heads of these wrenches are biased into engagement with the wrench handle in use and do not include structure to retain the wrench head in a disengaged condition to allow the ratchet head to freely hinge with respect to the wrench handle.

SUMMARY OF THE INVENTION

It is a general object of the invention to provide an improved ratchet wrench with a multi-position head which avoids the disadvantages of prior wrenches while affording additional structural and operating advantages.

An important feature of the invention is the provision of a ratchet wrench with a multi-position head which is of relatively simple and economical construction.

A still further feature of the invention is the provision of a wrench of the type set forth which includes retaining structure to retain the ratchet in a disengaged condition and allow the ratchet head to hinge freely with respect to the handle.

One or more of these features may be attained by providing a ratchet wrench which includes a ratchet head having a part-cylindrical surface with head teeth thereon and an elongated handle hingedly coupled to the head. The handle has first and second handle ends, an axis extending between the ends and an axial first bore opening at the first handle end. The wrench also includes a rod disposed in and moveable within the first bore between an engaged condition engageable with the head teeth for locking the head in a selected position relative to the handle and a non-engaged condition disengaged from the head teeth and accommodating relative movement of the head and handle and biasing structure for biasing the rod to the engaged condition. The wrench also includes retaining structure coupled to the rod for retaining the rod in its non-engaged condition.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE PREFERRED EMBODIMENTS

Figure 1:
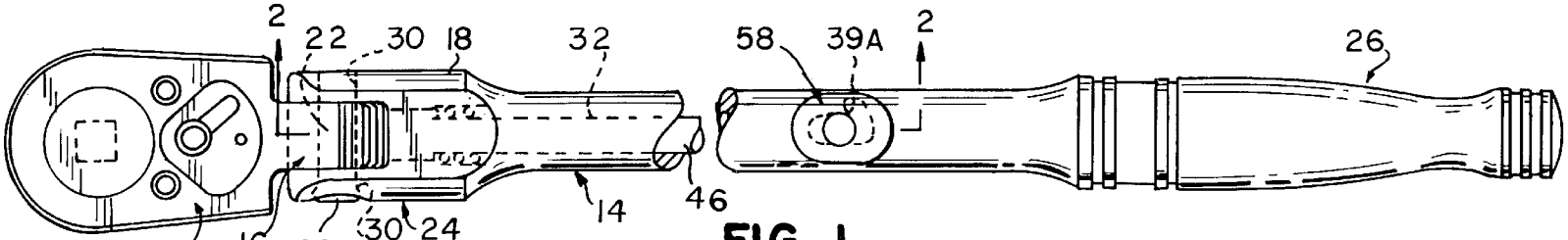
FIG. 1 is a top plan view, with portions broken away, of the multi-position ratchet head wrench of the present invention with the head engaged.

Referring to FIGS. 1–7, a ratchet wrench 10 is provided. The ratchet wrench 10 includes a multi-position ratchet head 12 hingedly coupled to an elongated handle 14.

The ratchet head 12 includes a known ratchet system and an engaging end 16. The engaging end 16 includes a part-cylindrical surface 18 having a plurality of head teeth 20 thereon. The engaging end 16 also includes a bore 22 disposed therethrough and having a bore axis. Each of the head teeth 20 has a centerline radiating from the bore axis. The centerlines between adjacent teeth are spaced to allow the head 12 to be put in one of multiple selected positions relative to the handle 14. The amount of spacing determines the number of selected positions. Fifteen degrees of spacing between adjacent centerlines has been used, but other spacings are possible. Each head tooth 20 has a pair of faces 20A, 20B (FIG. 6) that are substantially parallel to its centerline.

The handle 14 includes a bifurcated first end 24 closest to the ratchet head 12, a second end 26, and an axis extending between the ends 24, 26. The end 24 includes two legs 28, respectively disposed on opposite sides of the engaging end 16 and having a bore 30 therethrough (FIG. 1) coaxially aligned with the bore 22 of the engaging end 16. The legs 28 are connected by a wall 31.

The handle 14 also includes an axial bore 32 opening at the wall 31 of the first end 24. The axial bore 32 includes a larger diameter first portion 34 disposed adjacent to the wall 31 and a smaller diameter second portion 36. A shoulder 37 is disposed between the first and second portions 34 and 36.

The handle 14 also has a peripheral outer surface 38 and a wall 39 forming an engagement slot 40 communicating with the axial bore 32. The engagement slot 40 opens at the outer surface 38 and has a length along a central plane A (FIG. 1A) running along the axis of the handle 14. The engagement slot 40 has a first slot end 42 toward the ratchet head 12 and a second slot end 44 away from the ratchet head 12.

The wall 39 also forms a retaining slot 45 communicating with the end 44 of the engagement slot 40 and opening at the outer surface 38. The retaining slot 45 has a length along a central plane B which is inclined to the central plane A of the engagement slot 40. As seen best in FIG. 1A, and as discussed below, the central plane of the retaining slot 45 forms an angle β with the central plane of the engagement slot 40 that is preferably acute (less than 90° ), such as about 75°. A portion 39A (FIGS. 3 and 4) of the wall 39 forming the retaining slot 45 is disposed between the first and second ends 42, 44 of engagement slot 40.

Figure 7:
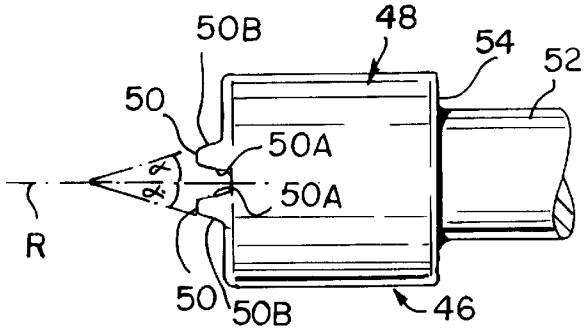
FIG. 7 is an enlarged, fragmentary, side elevational view of the engaging end of the rod.

The wrench 10 also includes a rod 46 (or plunger.) having an axis "R" (FIG. 7). The rod 46 is disposed in and moveable within the axial bore 32. The rod 46 includes a larger diameter engaging portion 48 having a pair of rod teeth 50. As seen in FIG. 7, each rod tooth 50 has a substantially planar inner face 50A which faces the corresponding face on the other tooth 50 and which is substantially parallel to the axis R. Each rod tooth 50 also has an angled outer face 50B that forms a small acute angler α with the axis R, such as 15°, which complements an engaged face 20A or 20B of a head tooth 20. The number and shape of the rod teeth 50 insures proper engagement with the head teeth 20 while preventing relative movement of the handle 12 and the rod 46 from their engaged condition under load.

The rod 46 also includes a smaller diameter portion 52 coupled to the engaging portion 48 and a shoulder 54 formed therebetween. If necessary, a portion of the smaller diameter portion 52 may have an even smaller diameter to provide additional clearance within the axial bore 32.

The wrench 10 also includes biasing structure, such as a coil spring 56 disposed about the smaller diameter portion 52 of rod 46 and within the larger diameter first portion 34 of the axial bore 32 between shoulder 54 and shoulder 37.

The wrench 10 further includes a button 58 coupled to the smaller diameter portion 52 of the rod 46 by a screw 60, or the like. The button 58 includes a finger-engaging portion 62 disposed above the outer surface 38 and preferably is contoured complementary to the outer surface 38 of the handle 14 and has an area large enough to cover the engagement slot 40 and retaining slot 45 to hide their existence to a user. In that respect, the finger-engaging portion 62. has a saddle-shape contour with two outer wings 63 (FIG. 4) which encompass the portion of the arcuate-shaped outer surface 38 at which the engagement slot 40 and retaining slot 45 open. The button 58 also includes a stem 64 coupled to the finger-engaging portion 62. The button 58 further includes a bore 66 (FIG. 2) through which the screw 60 passes to couple the button 58 to the rod 46. The stem 64 has an outer diameter slightly less than the width of either of the engagement slot 40 and retaining slot 45 and is moveable, as discussed below, within both.

The wrench 10 also includes a pin 66, or the like, disposed in the bore 30 of the handle 14 and the bore 22 to allow the ratchet head 12 to pivot about the axis of the pin 66 and with respect to the handle 14 when the rod 46, as discussed below, is not in its engaged condition.

Figure 2:
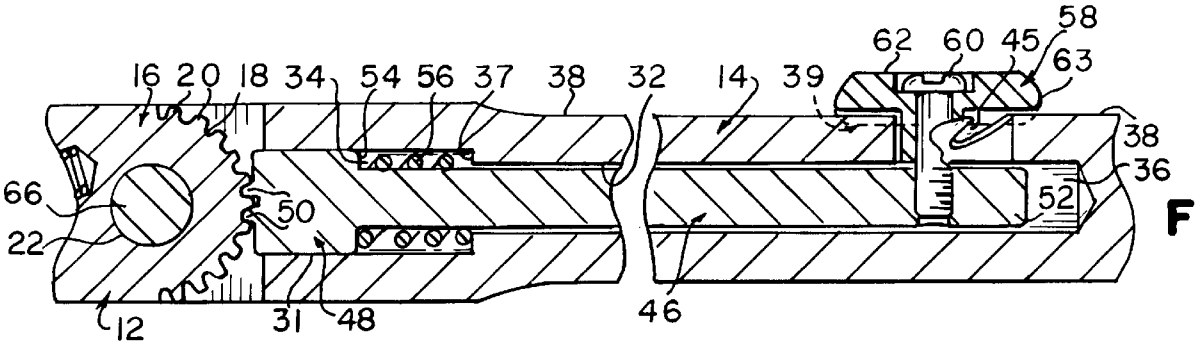
FIG. 2 is a is an enlarged, fragmentary, sectional view taken generally along the line 2—2 of FIG. 1.
Figure 3:
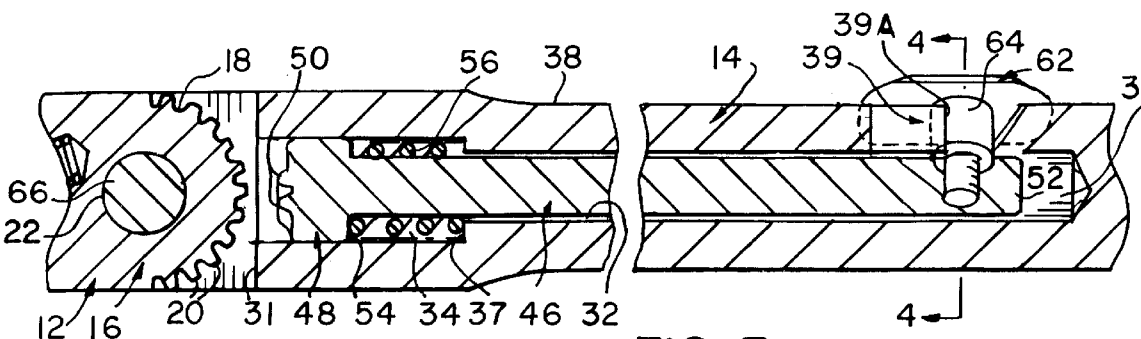
FIG. 3 is a is a view similar to FIG. 2 wherein the retaining structure is in a locked position for retaining the head-engaging rod in a non-engaged condition.
Figure 6:
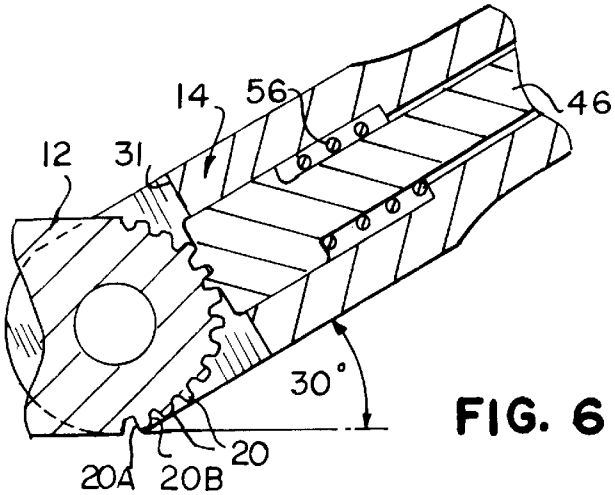
FIG. 6 is a fragmentary view similar to FIG. 2, illustrating the ratchet head engaged in a different selected position relative to the handle.

The wrench 10 is used as follows. The rod 46 has an engaged condition as seen in FIGS. 2 and 6 and a non-engaged condition, as seen in FIG. 3. The screw 60 biases the rod 46 to its engaged condition, wherein the rod teeth 50 are engaged with at least two of the head teeth 20 to lock the ratchet head 12 in a selected position relative to the handle 14.

To allow the ratchet head 12 to hinge freely or to change the position of the ratchet head 12 with respect to the handle 14, a user slides the button 58 against the force of the spring 56 from the first slot end 42 to the second slot end 44 (axially away from the ratchet head 12), thereby compressing the spring 56 and moving the rod teeth 50 out of engagement with the head teeth 20 and placing the rod 46 in its non-engaged condition (FIG. 3). Once the teeth are disengaged from one another, a user may move the head 12, with the hand not operating the finger-engaging portion 62, to a different selected position, such as for example that shown in FIG. 6, and release the button 58, causing the spring 56 to uncompress and bias the rod teeth 50 back into engagement with the head teeth 20.

Figure 4:
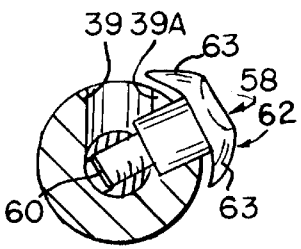
FIG. 4 is a sectional view taken. generally along line 4—4 of FIG. 3.

If a user wishes to maintain the rod 46 in its non-engaged condition and allow the ratchet head 12 to hinge freely about pin 66, the user slides the button 58 in the engagement slot 40, to the second slot end 44 and then rotates the button 58 (and coupled rod 46) clockwise about the axis of the handle 14, as shown in. FIG. 4. When the spring 56 attempts to bias the rod 46 to its engaged condition, the stem 64 of the button 58 will contact wall portion 39A retaining the rod 46 in its non-engaged condition. Since the retaining slot 45 is acutely angled with respect to the engagement slot 40, the angle of contact wall portion 39A aids in preventing the stem 64 of the button 58 from sliding back into engagement slot 40 (which would cause the rod 46 to return to its engaged condition).

Figure 1A:
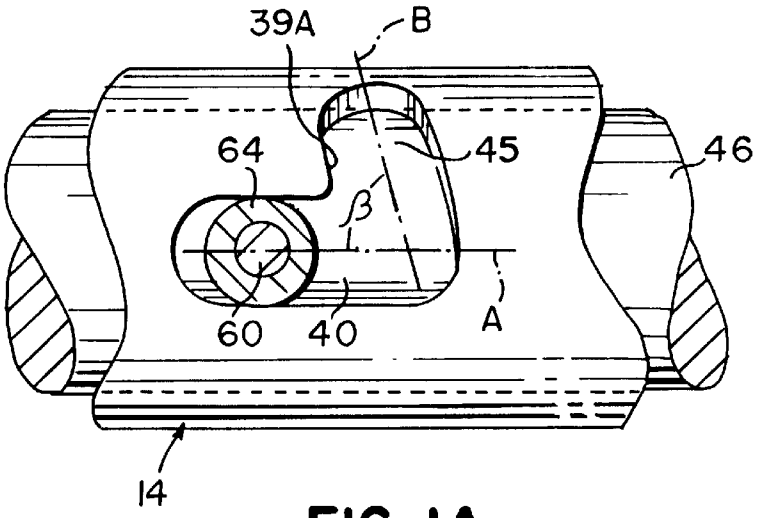
FIG. 1A is an enlarged, fragmentary top plan view, illustrating the engagement and retaining slots of FIG. 1 in greater detail, with the finger-engaging portion removed.
Figure 5B:
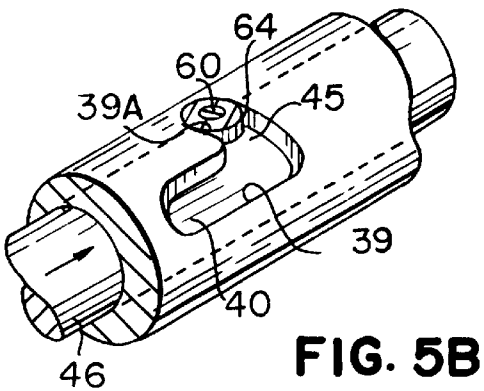
FIGS. 5A and 5B are fragmentary perspective views in partial section respectively illustrating the retaining structure in its locked and unlocked positions with the finger-engaging portion removed.
Figure 5A:
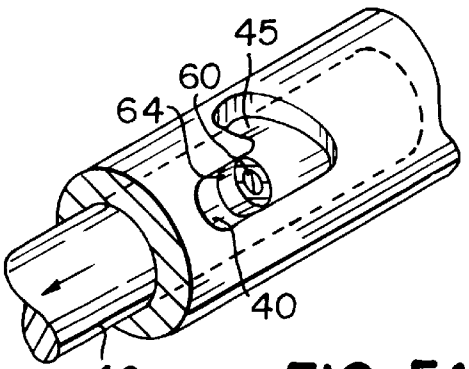
Figure 8:
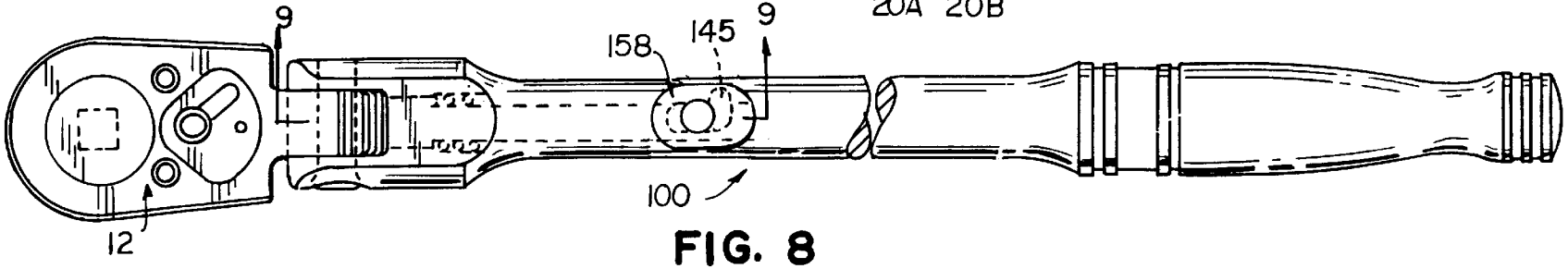
FIG. 8 is a view similar to FIG. 1, of an alternative embodiment of the present invention.
Figure 9:
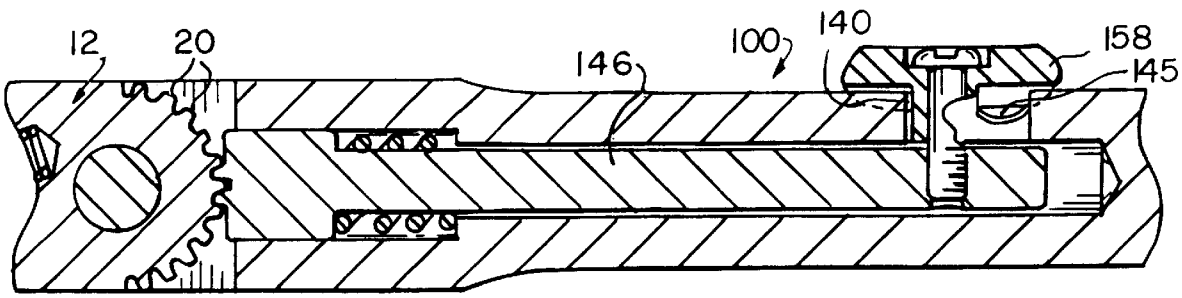
FIG. 9 is an enlarged, fragmentary, sectional view. taken generally along line 9—9 of FIG. 8.

FIGS. 8 and 9 disclose a second ratchet wrench 100 (wherein like numbers represent like elements) substantially identical to the ratchet wrench 10 of FIGS. 1∫7. A major difference is that it includes a button 158, and engagement slot 140 and a retaining slot 145 that are respectively closer to the ratchet head 12 than the button 58, engagement slot 40 and retaining slot 45 of the first embodiment. This placement allows a smaller length rod 146 and smaller length axial bore 132 to respectively replace the large length rod 46 and larger length axial bore 32. Other locations for the retaining structure would also be possible. Another difference is that the central plane of the retaining slot 145 is substantially perpendicular the central plane of the engagement slot 140. This allows the engagement slot 140 to have a smaller axial length than engagement slot 40, because the right-angled retaining slot 145 does not require the rod 146 to move axially back toward the handle 12 while still providing clearance between the head teeth 20 and the rod teeth 50.

Although the central planes of the engagement slot 40 and retaining slot 45 of the embodiment of FIGS. 1–7 form an acute angle with respect to one another, they may also form an angle that is about 90° as shown in FIGS. 8 and 9. Likewise, the central planes of engagement slot 140 and retaining slot 145 of the embodiment of FIGS. 8 and 9 may form an acute angle with respect to one another rather than an angle that is about 90°.

While particular embodiments of the present invention have been shown and described, it will be appreciated by those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A ratchet wrench comprising:

a ratchet head having a part-cylindrical surface with head teeth thereon;

an elongated handle hingedly coupled to the head and having first and second handle ends, an axis extending between the ends, an axial first bore opening at the first handle end, an engagement slot having first and second slot ends and communicating with the first bore, the second slot end disposed further from the ratchet head than the first slot end, and a retaining slot communicating with the second slot end of the engagement slot;

a rod having rod teeth and disposed in and moveable within the first bore between an engaged condition wherein the rod teeth are engageable with the head teeth for locking the head in a selected position relative to the handle and a non-engaged condition wherein the rod teeth are disengaged from the head teeth and accommodating relative movement of the head and handle, the rod having an outer periphery;

biasing structure for biasing the rod to the engaged condition; and retaining structure coupled to the rod for retaining the rod in its non-engaged condition, the retaining structure including a lock stem having a terminal it end coupled to the rod and disposed in the first bore and a second end projecting from the outer periphery of the rod, wherein the lock stem is receivable in the retaining slot to retain the rod in its non-engaged condition, and a button disposed outside the engagement and retaining slots, wherein the lock stem includes a stem portion integral with the button and having a bore and a fastener disposed through the bore and coupled to the rod.

2. The wrench of claim 1, wherein the engagement slot and the retaining slot respectively have central longitudinal planes inclined with respect to one another and forming an angle therebetween of less than 90°.

3. The wrench of claim 2 wherein the central planes of the engagement slot and the retaining slot form an angle therebetween of about 75°.

4. The wrench of claim 1, wherein the rod includes a larger diameter engaging portion coupled to a smaller diameter portion coupled to the button, wherein a rod shoulder is formed between the engaging portion and the smaller diameter portion.

5. The wrench of claim 4, wherein the first bore has a larger diameter first portion opening at the first handle end and a smaller diameter second portion and a shoulder formed therebetween, wherein the engaging portion of the rod is disposed in the larger diameter first portion.

6. The wrench of claim 5, wherein the biasing structure is disposed within the first bore portion.

7. The wrench of claim 1, wherein when the rod is in the engaged condition, at least two rod teeth are engaged with at least two head teeth.

8. The wrench of claim 1, wherein the retaining structure is disposed closer to the second handle end than to the first handle end.

9. The wrench of claim 1, wherein the retaining structure is disposed closer to the first handle end than to the second handle end.

10. The wrench of claim 1, wherein the button is disposed closer to the second handle end than to the first handle end.

11. The wrench of claim 1, wherein the button is disposed closer to the first handle end than to the second handle end.

12. A ratchet wrench comprising:

a ratchet head having a part-cylindrical surface with head teeth thereon;

an elongated handle hingedly coupled to the head and having first and second handle ends, an axis extending between the ends, an axial first bore opening at the first handle end, an engagement slot having first and second slot ends and communicating with the first bore, the second slot end disposed further from the ratchet head than the first slot end, and a retaining slot communicating with the second slot end of the engagement slot;

a rod having rod teeth and disposed in and moveable within the first bore between an engaged condition wherein the rod teeth are engageable with the head teeth for locking the head in a selected position relative to the handle and a non-engaged condition wherein the rod teeth are disengaged from the head teeth and accommodating relative movement of the head and handle;

biasing structure for biasing the rod to the engaged condition; and retaining structure coupled to the rod for retaining the rod in its non-engaged condition, the retaining structure including a lock stem coupled to the rod and axially movable in the engagement slot and receivable in the retaining slot to retain the rod in its non-engaged condition and a button disposed outside the engagement and retaining slots, wherein the lock stem includes a stem portion integral with the button and having a bore and a fastener disposed through the bore and coupled to the rod, wherein the engagement slot and the retaining slot respectively have central longitudinal planes inclined with respect to one another and forming an angle therebetween of less than 90°.

* * * * *

UNITED STATES PATENT AND TRADEMARK OFFICE

CERTIFICATE OF CORRECTION

PATENT NO. : 6,405,621 B1
DATED : June 18, 2002
INVENTOR(S) : Krivec, B. et al.

It is certified that error appears in the above-identified patent and that said Letters Patent is hereby corrected as shown below:

Column 5,
Line 21, “it” should be -- first --.

Signed and Sealed this

Twenty-eighth Day of January, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,405,621 B1
DATED : June 18, 2002
INVENTOR(S) : Krivec et al.

It is certified that error appears in the above-identified patent and that said Letters Patent is hereby corrected as shown below:

Title page,
Item [56], References Cited, U.S. PATENT DOCUMENTS, add:

| | | |
|---|---|---|
| -- 5,943,924A | 8/1999 | Jarvis |
| 6,167,787A | 1/2001 | Jarvis --. |

Signed and Sealed this

Seventeenth Day of January, 2006

JON W. DUDAS
*Director of the United States Patent and Trademark Office*